US005984171A

United States Patent [19]

Schwarzli

[11] Patent Number: 5,984,171

[45] Date of Patent: Nov. 16, 1999

[54] LOCKABLE CASH BOX FOR A VENDER

[75] Inventor: Josef W. Schwarzli, Stouffville, Canada

[73] Assignee: Machine-O-Matic Limited, Newmarket, Canada

[21] Appl. No.: 09/055,752

[22] Filed: Apr. 7, 1998

[30] Foreign Application Priority Data

Jun. 3, 1997 [CA] Canada ..... 2206733

[51] Int. Cl.[6] ..... G07B 15/00

[52] U.S. Cl. ..... 232/15; 232/1 D; 194/350; 109/46; 109/47; 109/55

[58] Field of Search ..... 232/15, 16, 1 D, 232/1 R; 194/350; 109/46, 47, 55

[56] References Cited

U.S. PATENT DOCUMENTS

| | | | |
|---|---|---|---|
| 1,933,264 | 10/1933 | Hoyt | 232/15 |
| 2,096,476 | 10/1937 | Veale | 232/15 |
| 2,109,864 | 3/1938 | Long | 232/15 |
| 2,172,554 | 9/1939 | Veale | 232/15 |
| 2,604,259 | 7/1952 | Anderson | 232/15 |
| 2,783,937 | 3/1957 | Hudson | 232/15 |
| 3,016,185 | 1/1962 | Osborne | 232/15 |
| 3,018,148 | 1/1962 | Probasco . | |
| 3,214,089 | 10/1965 | Smith | 232/15 |
| 3,292,849 | 12/1966 | Ewing | 232/15 |
| 3,333,764 | 8/1967 | Pennell | 232/15 |
| 3,390,753 | 7/1968 | Bolen et al. . | |
| 3,433,185 | 3/1969 | Roberts | 109/55 |
| 3,804,294 | 4/1974 | Householder . | |
| 3,926,366 | 12/1975 | Sciortino | 232/15 |
| 5,131,519 | 7/1992 | Ra | 194/350 |

FOREIGN PATENT DOCUMENTS

| | | |
|---|---|---|
| 807880 | 1/1959 | United Kingdom . |
| 1080872 | 8/1967 | United Kingdom . |

*Primary Examiner*—Brian K. Green
*Assistant Examiner*—William L. Miller
*Attorney, Agent, or Firm*—Dimock Stratton Clarizio; Mark B. Eisen

[57] ABSTRACT

A bulk vender having a lockable cash box which has a coin aperture into which coins fall as they are ejected from the coin mechanism. During removal of the cash box from the vender a blocking mechanism automatically blocks the coin aperture, rendering the contents of the cash box accessible only to someone who possesses the key for unlocking the cash box. In a preferred embodiment the blocking mechanism is actuated by rotation of the lock which locks the cash box into the vender.

17 Claims, 7 Drawing Sheets

LOCKABLE CASH BOX FOR A VENDER

FIELD OF THE INVENTION

This invention relates to vending machines. In particular, this invention relates to a lockable cash box for a bulk vender or the like.

BACKGROUND OF THE INVENTION

Bulk venders, colloquially known as "gum ball machines", are widely used for dispensing confectionaries and other small articles. A typical bulk vender has a hopper assembly comprising a transparent globe which functions as a merchandise storage bin, seated over a dispensing wheel which revolves in a hopper. A patron deposits the required coinage into the coin mechanism and turns the handle, which rotates the dispensing wheel to convey a preset amount of merchandise to the inlet of a dispensing chute. The hopper assembly is located over a body which is mounted on a base, defining a secure compartment containing a cash box into which the coin mechanism ejects the deposited coins.

Bulk venders are typically purchased and maintained by vender operators, who install and service the venders at high traffic locations such as shopping malls, restaurants and the like. The operator periodically re-stocks the venders and collects the proceeds from the sale of articles dispensed by the venders, and typically remits a portion of the proceeds to the owner of the premises. A large vender operator may operate many hundreds of bulk venders, employing service personnel to service the venders and deliver the coins which have accumulated within the cash box to the operator.

Bulk venders are intended particularly for use in unsupervised public areas, and as such are designed to resist tampering, theft and vandalism by patrons. However, since it is not feasible to track the number of articles dispensed from each vender, so that the vender operator can never know how many coins should be collected from any particular vender during a service call, the operator is vulnerable to the theft of coins by the operator's service personnel. The operator can also be vulnerable to the substitution of slugs for coins by service personnel before the collected coins are delivered to the operator. In either case the operator's proceeds can be significantly reduced.

It is accordingly desirable to provide a lockable cash box for a bulk vender which can be removed in its entirety by service personnel, but remains in a locked condition and can be unlocked only by the operator, the contents of the cash box being thereby inaccessible to service personnel. This would significantly reduce or eliminate opportunities for theft or "skimming" by service personnel prior to delivery of the proceeds to the operator.

SUMMARY OF THE INVENTION

The present invention provides a bulk vender with a lockable cash box having a coin aperture into which coins fall as they are ejected from the coin mechanism. The cash box has an external lock which can be unlocked by service personnel to remove the cash box from the vender, but upon removal of the cash box from the vender a blocking mechanism blocks the coin aperture, rendering the contents of the cash box accessible only to someone who possesses a key for unlocking a second lock on the cover of the cash box. Service personnel are thereby prevented from stealing coins from the cash box, and at the same time the servicing of bulk venders is facilitated by the ease with which the cash box is removed and replaced.

The present invention thus provides a cash box comprising a container having a top, a bottom and side walls defining an interior of the container, the top including a coin aperture, and an opening allowing access to the interior of the container, a removably attachable panel releasably secured to the opening in the container by a first lock, to secure the interior of the container against access, and a blocking mechanism for blocking the coin aperture disposed within the interior of the container, comprising a blocking member having an aperture aligned with the coin aperture when the blocking member is in an operating position, the blocking member being movable between the operating position and a blocking position in which the aperture is out of alignment with the coin aperture such that the blocking member blocks the coin aperture, and a retaining mechanism for retaining the blocking member in the operating position, wherein movement of the blocking member to the operating position activates the retaining mechanism to retain the blocking member in the blocking position when the blocking member is moved back to the blocking position.

The present invention further provides a cash box comprising a container having a bottom and side walls defining an interior of the container, a top comprising a removably attachable cover releasably secured to the container by a cover lock, to secure the interior of the container against access, the top including a coin aperture, and a blocking mechanism for blocking the coin aperture disposed within the container, comprising a blocking member having an aperture aligned with the coin aperture when the blocking member is in an operating position, the blocking member being movable between the operating position and a blocking position in which the aperture is out of alignment with the coin aperture such that the blocking member blocks the coin aperture, and a retaining mechanism for retaining the blocking member in the operating position, wherein the retaining mechanism is primed from the interior of the container to allow the blocking member to move from the blocking position to the operating position, and whereby movement of the blocking member to the operating position causes the retaining mechanism to retain the blocking member in the blocking position when the blocking member is moved back to the blocking position.

The present invention further provides a vender comprising a merchandise storage portion and a secure compartment defined within a body, a coin mechanism mounted in the body for receiving a coin or token and conveying the coin or token into the secure compartment for deposit into a cash box, the cash box comprising a container having a top, a bottom and side walls defining an interior of the container, the top including a coin aperture, and an opening allowing access to the interior of the container, a removably attachable panel releasably secured to the opening in the container by a first lock, to secure the interior of the container against access, and a blocking mechanism for blocking the coin aperture disposed within the container, comprising a blocking member having an aperture aligned with the coin aperture when the blocking member is in an operating position, the blocking member being movable between the operating position and a blocking position in which the aperture is out of alignment with the coin aperture such that the blocking member blocks the coin aperture, and a retaining mechanism for retaining the blocking member in the operating position, wherein movement of the blocking member to the operating position activates the retaining mechanism to retain the blocking member in the blocking position when the blocking member is moved back to the blocking position.

BRIEF DESCRIPTION OF THE DRAWINGS

In drawings which illustrate by way of example only a preferred embodiment of the invention.

DETAILED DESCRIPTION OF THE INVENTION

Figure 1:
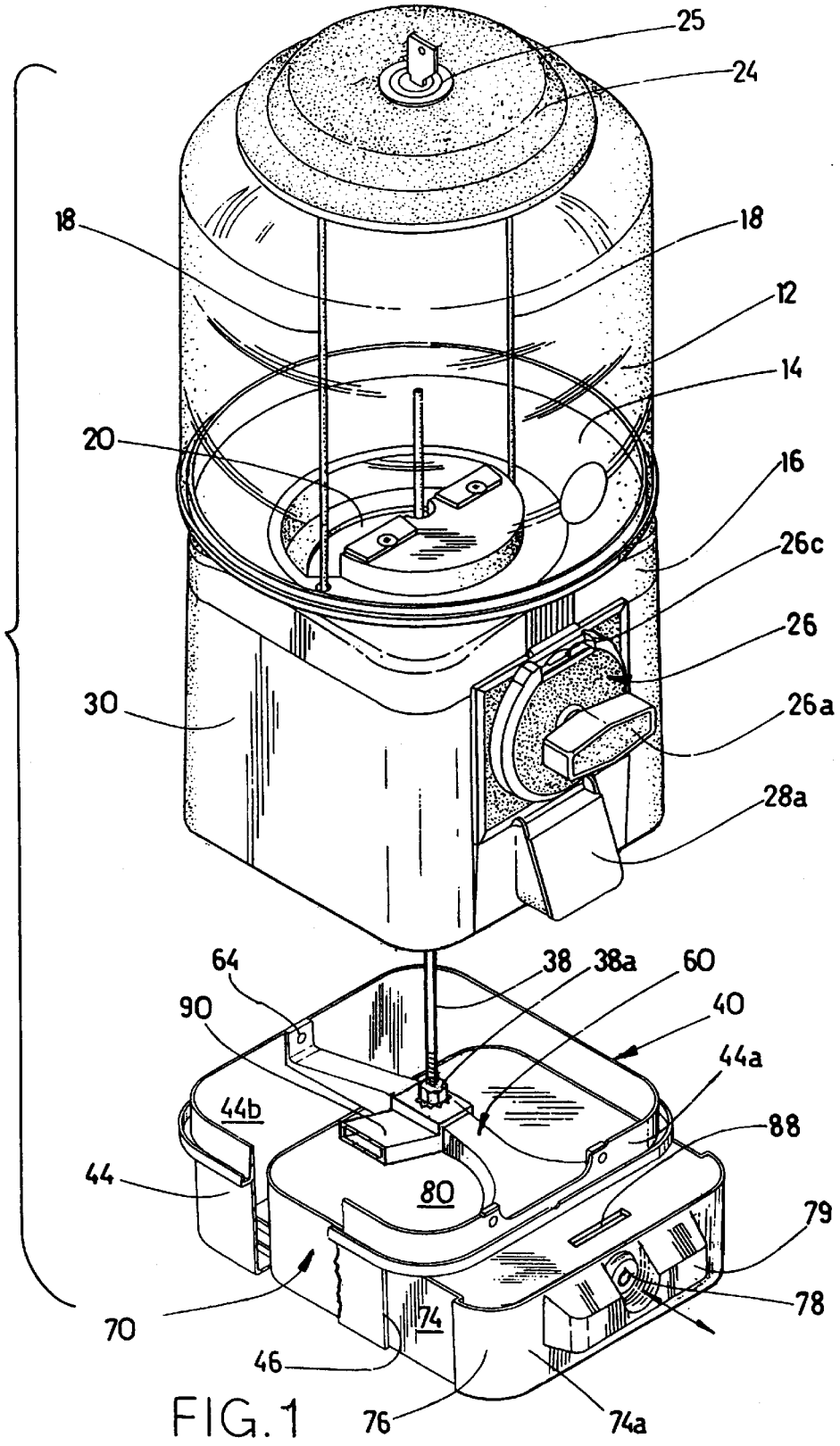
FIG. 1 is a partially exploded perspective view of a bulk vender embodying the invention.

FIG. 1 illustrates by way of example a bulk vender 10 embodying the invention. The vender 10 comprises a transparent article storage bin or globe 12 which stores the merchandise to be dispensed, having a top opening covered by a top 24 to prevent unauthorized access to the merchandise stored in the globe 12. The globe 12 is seated on a collar 14 which nests in a hopper 16 in which the dispensing wheel 20 revolves. The hopper 16, collar 14 and globe 12 are typically secured together as a unitary hopper assembly by bolts 18 extending through a retaining ring (not shown) clamping the globe 12 to the hopper 16.

The hopper assembly is mounted on a body 30, which is typically a unitary plastic casing having an open top and bottom, which comprises a base 40. The hopper assembly is secured to the base 40 by a center rod 38 which extends from the base 40 upwardly through the body 30, the hopper 16, the dispensing wheel 20 and the globe 12, and into the top 24 which is locked to the center rod 38 by a cylindrical lock 25, thus securing the components of the vender 10 together.

A coin mechanism 26 mounted in the body 30 provides a coin slot 26*c* and a handle 26*a* accessible to a patron, and is designed so that the handle 26*a* can be rotated only when the correct coinage is inserted into the coin slot 26*c*. The coin mechanism 26 is positioned so that a dispensing gear 27 meshes with a toothed edge of the dispensing wheel 20, thus rotating the dispensing wheel 20 as the handle 26*a* of the coin mechanism 26 is turned until a product carrier (not shown) containing a preset amount of merchandise comes into alignment with the inlet of a dispensing chute 28, to convey the merchandise to the user through swinging door 28*a*. As the handle 26*a* is turned the coin mechanism 26 deposits the inserted coinage into a secure compartment defined within the body 30.

The invention will be described herein by way of example in the context of a bulk vender 10 that accepts coins 1 of a selected denomination. It will be appreciated that the description applies equally to a bulk vender that accepts coins of any currency or denomination, or tokens, checks or any other like element capable of releasing the coin mechanism 26 to dispense merchandise from a bulk vender 10. The invention is not intended to be limited by the type of coin, token, check or other element used to operate the coin mechanism 26.

Figure 2:
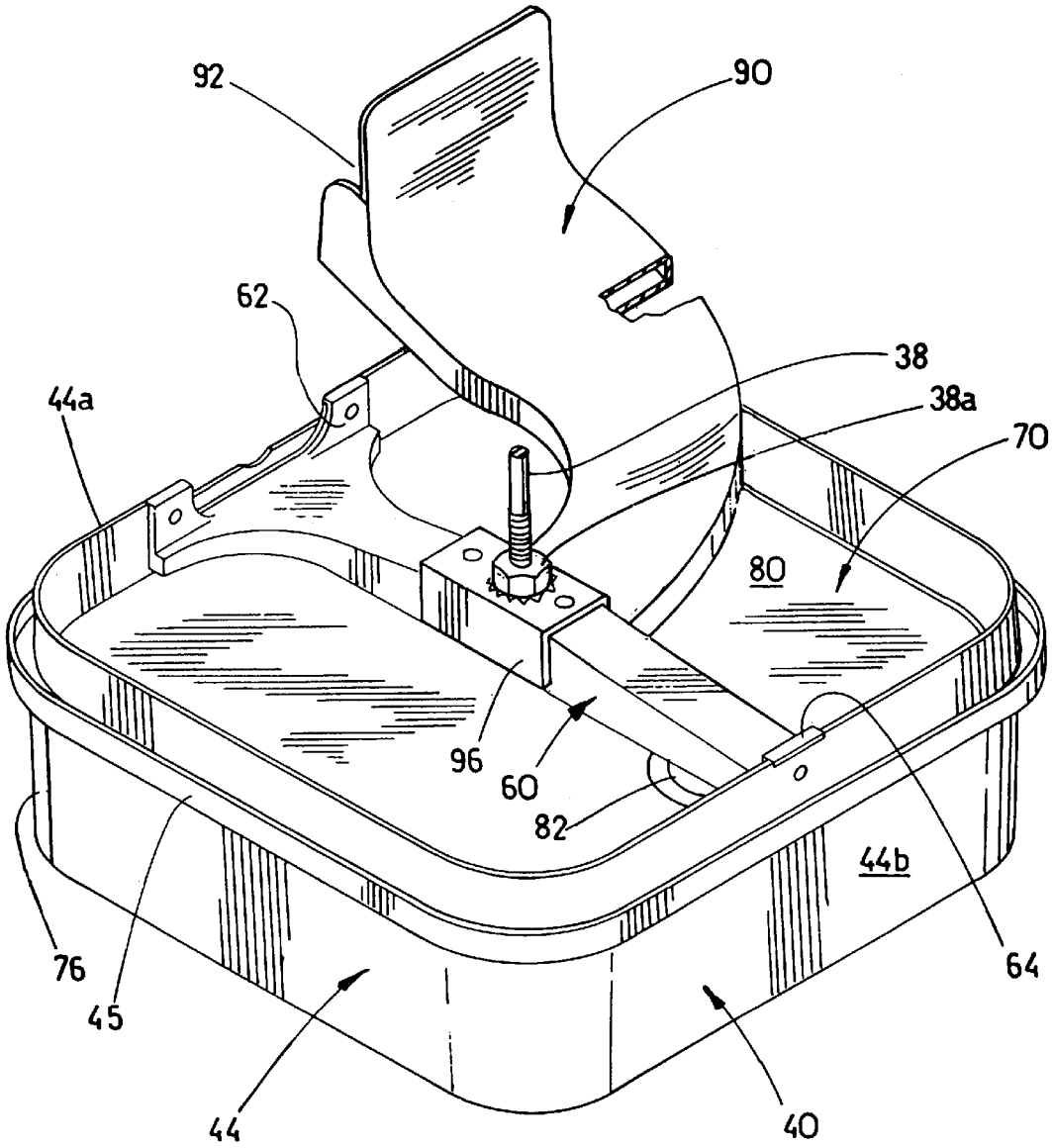
FIG. 2 is a perspective view of a preferred embodiment of the base for the bulk vender of FIG. 1 showing the position of the coin guide chute.
Figure 3:
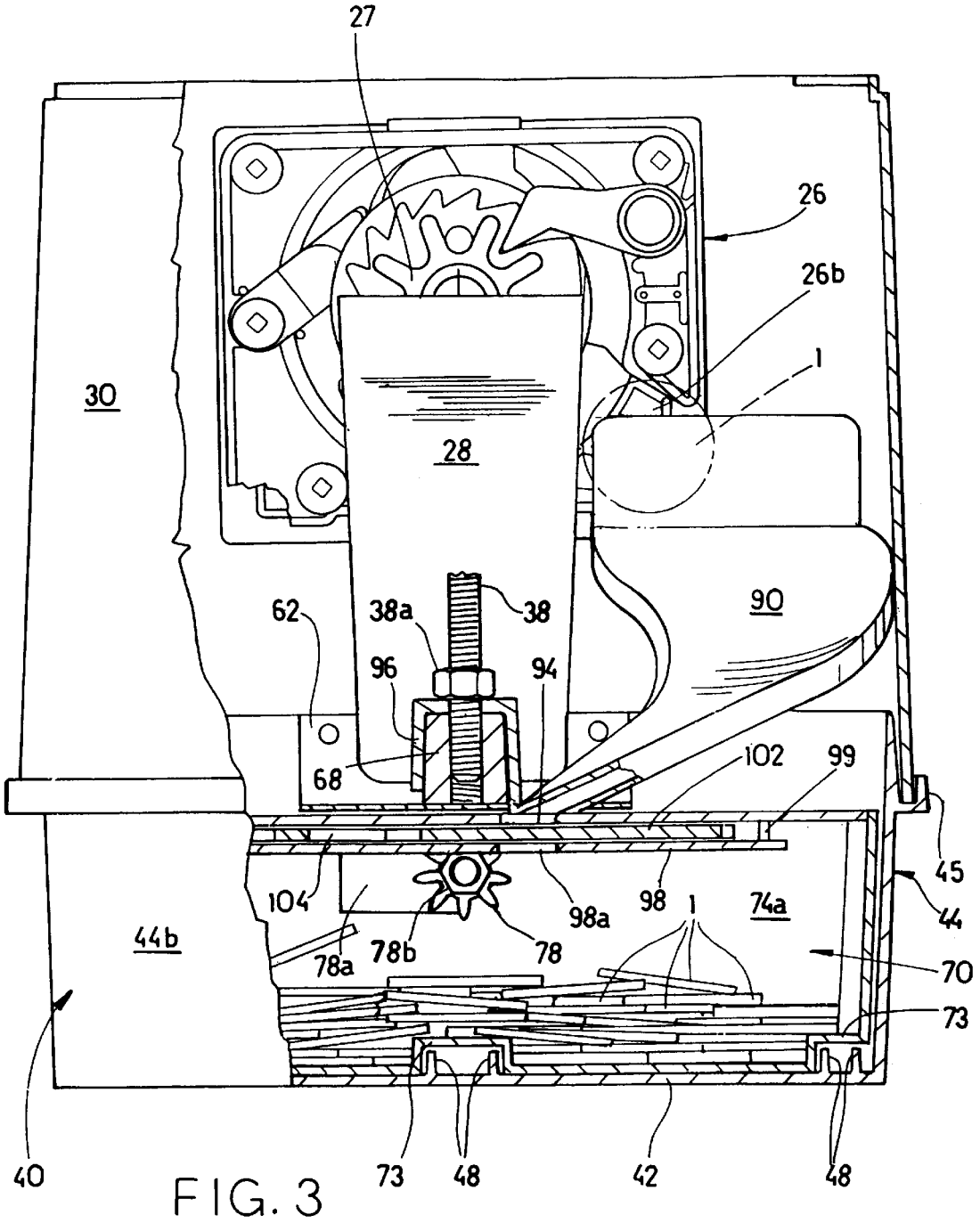
FIG. 3 is a partially cutaway rear elevation of the base and body of the bulk vender of FIG. 1.
Figure 5:
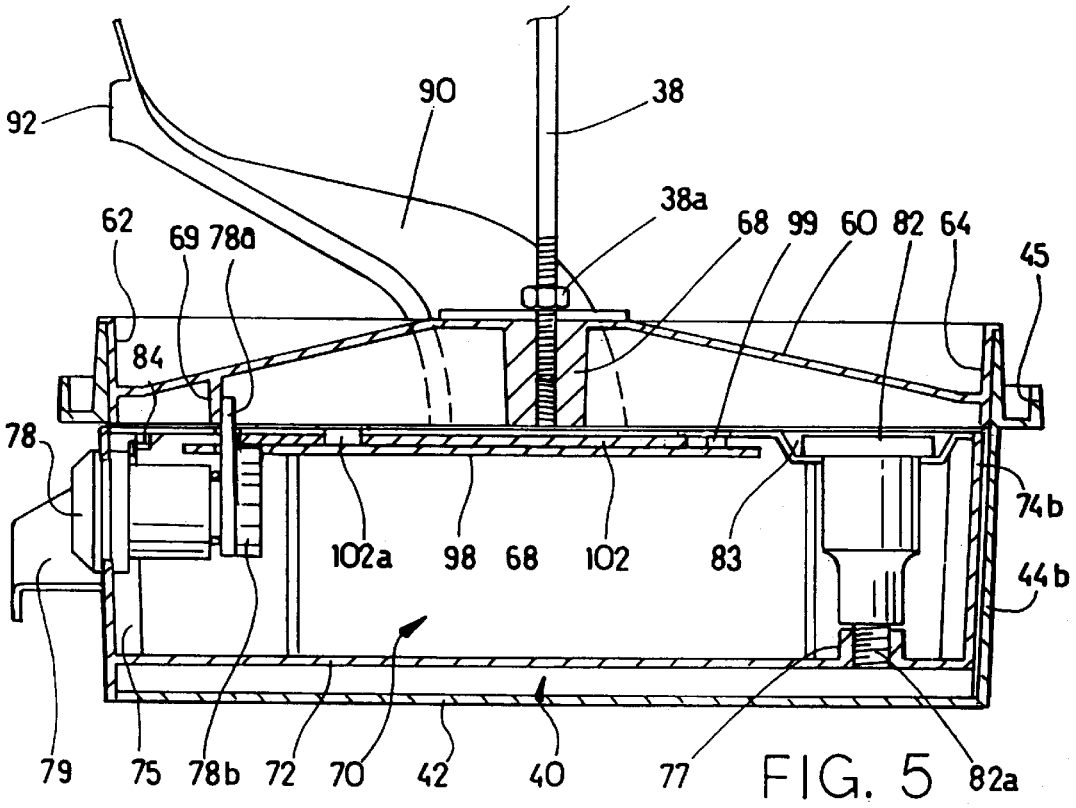
FIG. 5 is a cross-sectional side elevation of the base of FIG. 2.

In the preferred embodiment of the invention a lockable cash box 70 is contained within the base 40, which as illustrated in FIGS. 2 and 3 comprises a floor 42 circumscribed by a base wall 44 provided with a lip 45 forming a channel into which the body 30 nests in the assembled vender 10. It is advantageous to provide a clear space within the base 40 to facilitate unhindered insertion and removal of the cash box 70, and in the preferred embodiment this is accomplished by providing a bridge 60 extending between the front face 44*a* and rear face 44*b* of the base wall 44, to which the center rod 38 can be affixed to secure the hopper assembly to the base 40. A threaded socket 68 is bored or formed in the center of the bridge 60 for threaded engagement to the center rod 38, and a nut 38*a* can be used to adjust the depth of the center rod 38 in the socket 68, as best seen in FIG. 5. The bridge 60 thus provides a secure structure to which the center rod 38 can be affixed, leaving a clear space within the base 40 to accommodate the cash box 70. Such a construction is described and illustrated in the applicant's co-pending U.S. patent application Ser. No. 08/929,403 filed Sep. 15, 1997 for a "Bulk Vendor Base with Removable Cash Box", which is incorporated herein by reference.

According to a preferred embodiment of the invention, the base 40 accommodates a removable, lockable cash box 70 which when in use is disposed within the base 40, but which is accessible from outside of the base 40 for removal and emptying of its contents.

The cash box 70 is slidably disposed within the base 40, and in the preferred embodiment can be inserted and removed like a drawer through an opening 46 extending along a face of the base wall 44, as shown in FIG. 1. The floor 42 of the base 40 may be provided with ridges 48, as shown in FIG. 3, to accommodate the heads of bolts (not shown) affixing the base 40 to a stand or the stems of rubber feet (not shown) for free-standing venders 10.

Figure 4:
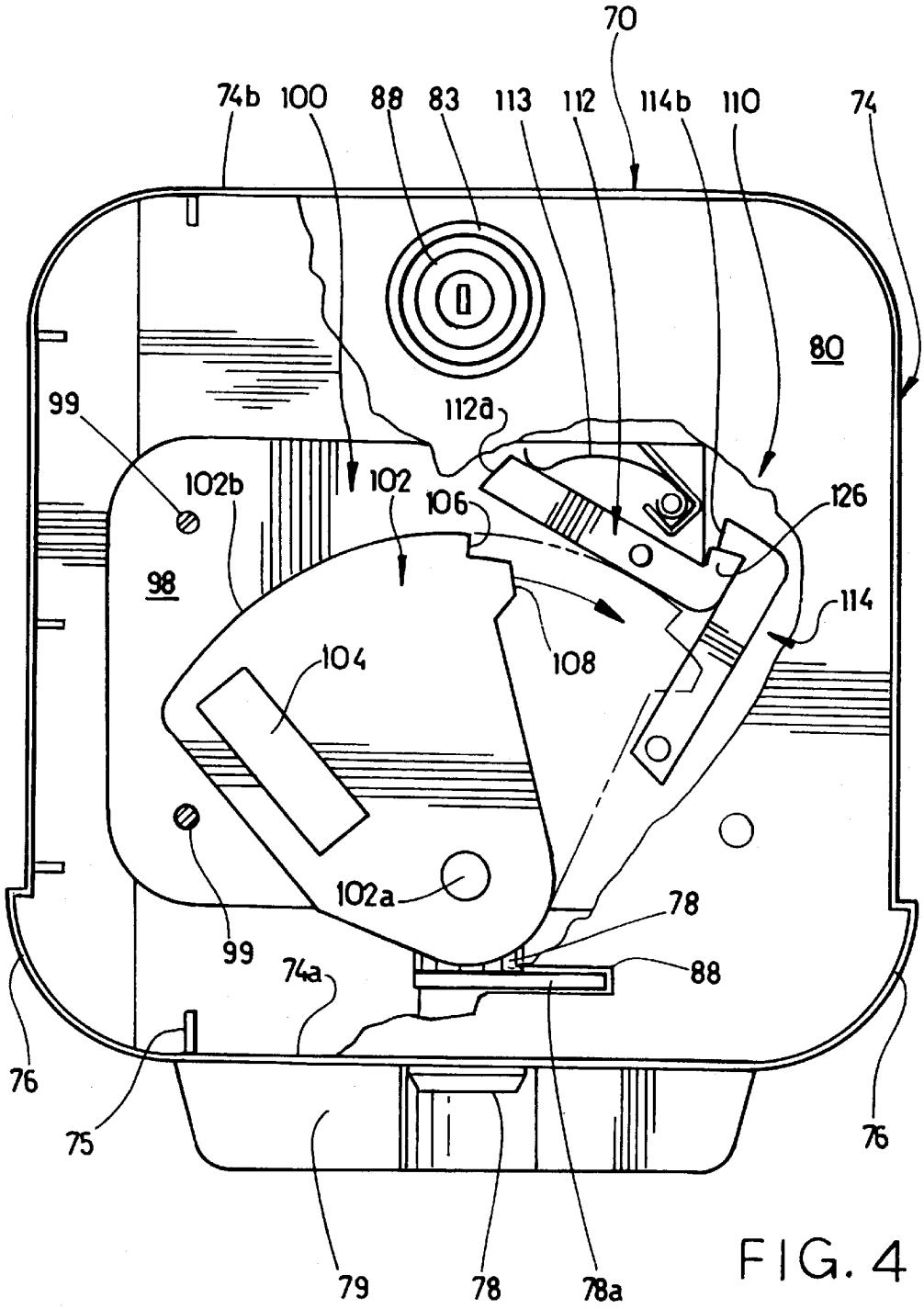
FIG. 4 is a partially cutaway top plan view of the cash box.

The cash box 70, shown in FIGS. 4 and 5, is formed from a container comprising a bottom or floor 72 and walls 74, preferably integrally moulded or cast from metal or plastic. The floor 72 is provided with channels 73 to accommodate the ridges 48 on the floor 42 of the base 40. In the embodiment shown the wall 74*a* that aligns with the opening 46 in the base 40 is configured with shoulders 76 that conform to the shape of the base wall 44, as seen in FIG. 1, so that in the closed position the base 40 has a uniform appearance. This configuration also makes it more difficult to insert a tool between the cash box 70 and the base wall 44, thus resisting attempts to pry the cash box 70 out of the base 40. The cash box 70 further comprises a top, in the preferred embodiment closed by a detachable panel comprising a cover 80 as described below, which together with the floor 42 and walls 74 define the interior of the container.

The cash box 70 is provided with an external lock 78, preferably disposed centrally along the wall 74*a* that aligns with the opening 46 in the base 40, and may optionally be provided with a handle 79 for gripping when removing the cash box 70 from or inserting the cash box 70 into the base 40. The external lock 78 serves to lock the cash box 70 into the base, and can be a conventional tubular lock with a latch

78*a* that engages any convenient surface within the base 40 or body 30 to prevent removal of the cash box 70. In the preferred embodiment the underside of the bridge 60 is provided with a latching surface 69, best seen in FIG. 5, against which the latch 78*a* can be engaged securely. The external lock 78 is intended to be operated by service personnel, as described below.

Figure 6A:
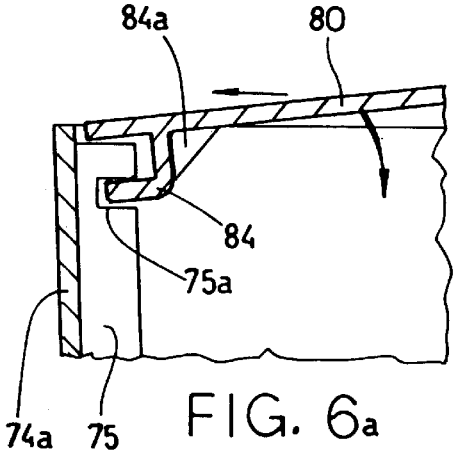
FIG. 6*a* is an enlarged cross-section showing the manner of locking the cash box cover to the cash box.
Figure 6B:
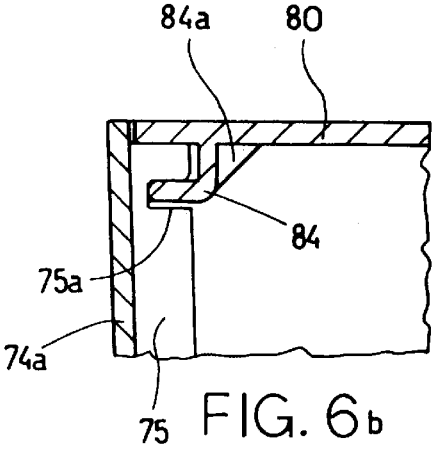
FIG. 6*b* is an enlarged cross-section showing the cash box cover in a locked position on the cash box.

The cash box 70 top comprises a cover 80 with a cover lock 82, for locking the cash box 70 and thereby rendering the contents inaccessible to service personnel. The cover lock 82 may also be a conventional tubular lock, having a stem 82*a* which threadedly engages into a socket 77 formed into the floor 72 of the cash box 70. The cover lock 82 is located along one end of the cover 80 (the rear end in the embodiment shown), and along the other end are provided flanges 84 with reinforcing ribs 84*a* which latch into notches 75*a* provided in ribs 75 formed along the interior of the front face 74*a*, as shown in FIGS. 6*a* and 6*b*. Thus, the cover 80 can be secured to the container by inserting the flanges 84 into the notches 75*a* and engaging the stem 82*a* of cover lock 82 into the socket 77.

It will be appreciated that the end of the cover 80 opposite the cover lock 82 can be secured to the container in numerous other ways that will be well known to those skilled in the art, including hinges, bosses or the like, and the invention is not intended to be limited to the particular manner of securing the cover 80 to the container as shown and described herein. The important feature is the provision of a cover lock 80 which must be unlocked to open the cover 80 and which uses a different key from that used for the external lock 78. The key for the cover lock 82 is maintained by the operator, as described below.

Preferably the cover lock 82 is recessed into the cover 80, as at 83, so that the cover lock 82 does not project above the top of the cash box 70 and thus does not interfere with the insertion or removal of the cash box 70 into or out of the base 40.

The cover 80 is provided with a slot 88, best seen in FIG. 4, through which the latch 78*a* of the external lock 78 projects when the external lock 78 is in the locked position shown in FIG. 5. The slot 88 should be only as large as necessary to allow the latch 78*a* to pass therethrough unhindered, so that access through the slot 88 to the interior of the cash box 70 is effectively blocked by the external lock 78, to avoid the possibility of coins 1 being retrieved from inside the locked cash box 70 through the slot 88.

The cover 80 is provided with a coin aperture 86, through which coins 1 ejected from the coin ejection ramp 26*b* of the coin mechanism 26 are deposited into the cash box 70. Preferably the coin aperture 86 is disposed generally centrally in the top of the cash box 70, which allows coins 1 dropping into the cash box 70 to pile up outwardly from the center and avoids a local accumulation of coins 1 which could block the coin aperture 86. Coins 1 are directed through the coin aperture 86 by a guide chute 90 having an inlet 92 adjacent to the coin ejection ramp 26*b* of the coin mechanism 26 and an outlet 94 disposed above the coin aperture 86. Preferably the guide chute 90 is formed with a continuous curve and a substantially uniform pitch, to prevent coins 1 from becoming lodged in the guide chute 90. To facilitate deposit through the coin aperture 86 the outlet 94 of the coin chute 90 may have a chamfered lower edge, as shown in FIG. 3.

In the preferred embodiment the guide chute 90 is maintained in alignment with the ejection ramp 26*b* of the coin mechanism 26 and coin aperture 86 by a brace 96 secured to the bridge 60 by the nut 38*a*, as shown in FIGS. 2 and 3. The guide chute 90 may be configured and/or mounted in any other suitable fashion with its inlet 92 positioned to receive coins 1 ejected from the coin mechanism 26 and its outlet is positioned to deposit the coins 1 into the coin aperture 86.

Locking the cover 80 of the cash box 70 will not render the contents of the cash box 70 inaccessible if the coin aperture 86 remains open, as service personnel could invert the cash box 70 and try to extract coins through the coin aperture. The invention accordingly provides a blocking mechanism 100 for blocking access to the coin aperture 86 when the cash box 70 is removed from the vender 10. The blocking mechanism 100, shown in FIG. 4, is concealed within the cash box 70, in the preferred embodiment being affixed beneath the cover 80.

Figures 4A, 4B, 4C:
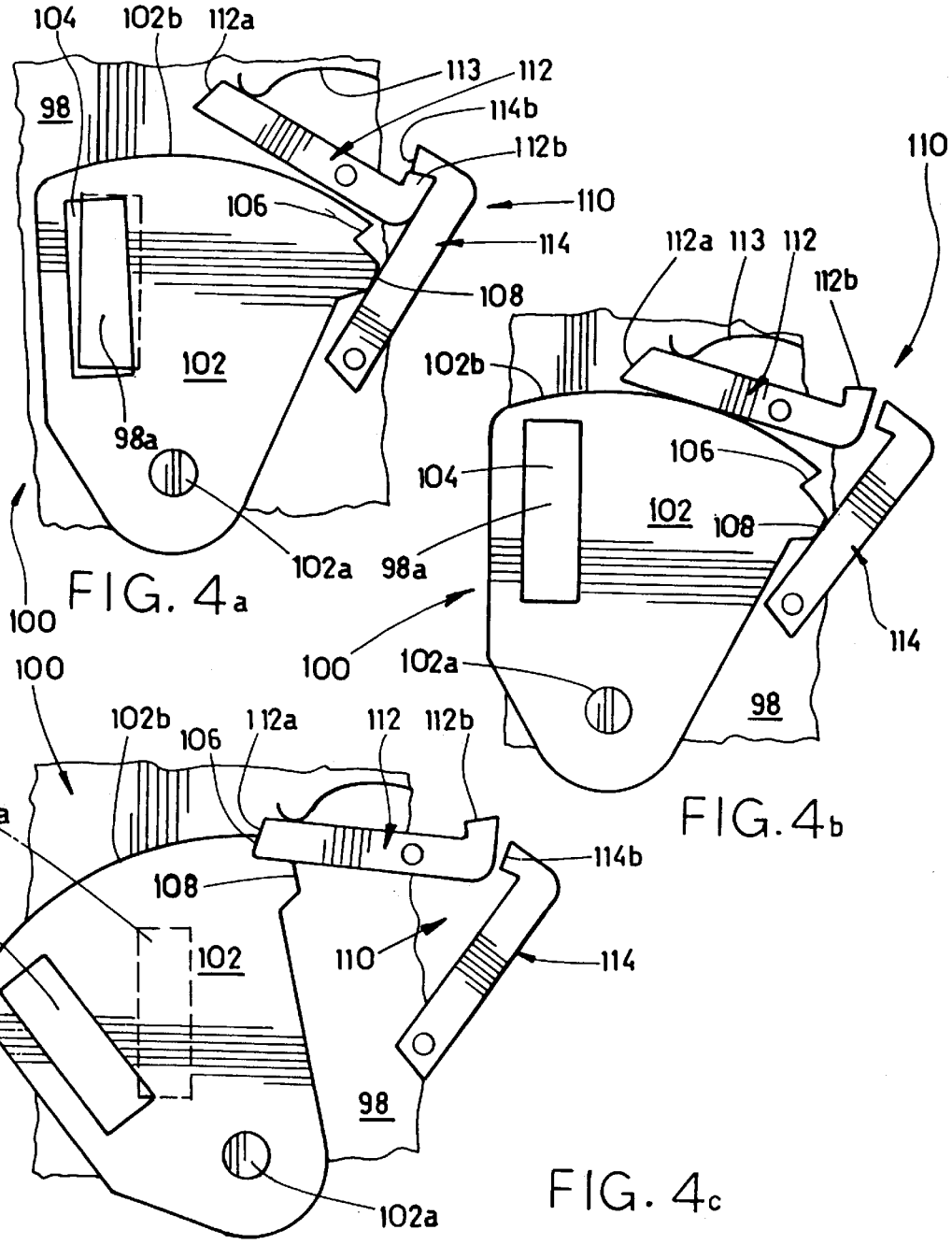
FIG. 4*a* is a top plan view of the coin aperture blocking mechanism still in a primed position during the process of insertion into the vender.
FIG. 4*b* is a top plan view of the coin aperture blocking mechanism in an operational position after insertion into the vender.
FIG. 4*c* is a top plan view of the coin aperture blocking mechanism in a blocking position after removal from the vender.

The blocking mechanism 100 comprises a blocking member 102 having an aperture 104 approximating the size of the coin aperture 86. The blocking member 102 is mounted so as to move between an operating position in which the aperture 104 is in alignment with the coin aperture 86, as shown in FIG. 4*b*, and a blocking position in which the aperture 104 is out of alignment with the coin aperture 86, as shown in FIG. 4*c*, in which position the blocking member 102 blocks the coin aperture 86 and thereby blocks access to the interior of the cash box 70. In the preferred embodiment shown the blocking member 102 is pivotally mounted to the cover 80 by a rivet 102*a*, however the blocking member 102 may be mounted in any other suitable fashion that allows it to move between the operating and blocking positions.

The blocking mechanism 100 is designed so that when the cash box 70 is empty the blocking member 102 can be moved to the operating position by service personnel, but when the cash box 70 is removed from a vender 10 the blocking member cannot be moved out of the blocking position by service personnel. In the preferred embodiment this is accomplished by using the external lock 78 as an actuator for the blocking member 102, and providing a retaining mechanism 110 which allows the blocking member 102 to move to the operating position when inserted into a vender 10, but once the blocking member moves out of the operating position as the cash box 70 is removed from a vender 10 a retaining dog 112 locks the blocking member 102 into the blocking position.

The retaining dog 112 is pivotally mounted to the cover 80, biased toward the detent 106 by a spring 113 affixed to the cover 80, and has a tail 112*a* which engages against a detent 106 on the blocking member 102, as shown in FIG. 4*c*, to prevent the blocking member 102 from pivoting to the operating position after the cash box 70 has been removed from a vender 10. The blocking member 102 can thus be pivoted to the operating position only by first pivoting the tail 112*a* of the retaining dog 112 away from the detent 106, as shown in FIG. 4*b*, and this can only be done from inside the cash box 70.

In order to allow the blocking member 102 to move to the operating position when the cash box 70 is inserted into a vender 10, a pivotally mounted priming dog 114 is provided to retain the retaining dog 112 in a primed position in which the dog 112 does not impinge into the path of the blocking member 102. The priming dog 114 has a hooked head 114*b* which engages a head 112*b* of the retaining dog 112. (In the embodiment shown the head 112*b* of the retaining dog 112 is also hooked, which is expedient for manufacturing purposes. However, it will be apparent that the head 112*a* of the retaining dog 112 need not be hooked so long as it provides a surface which can be engaged by the head 114*b* of the priming dog 114.)

Figure 7:
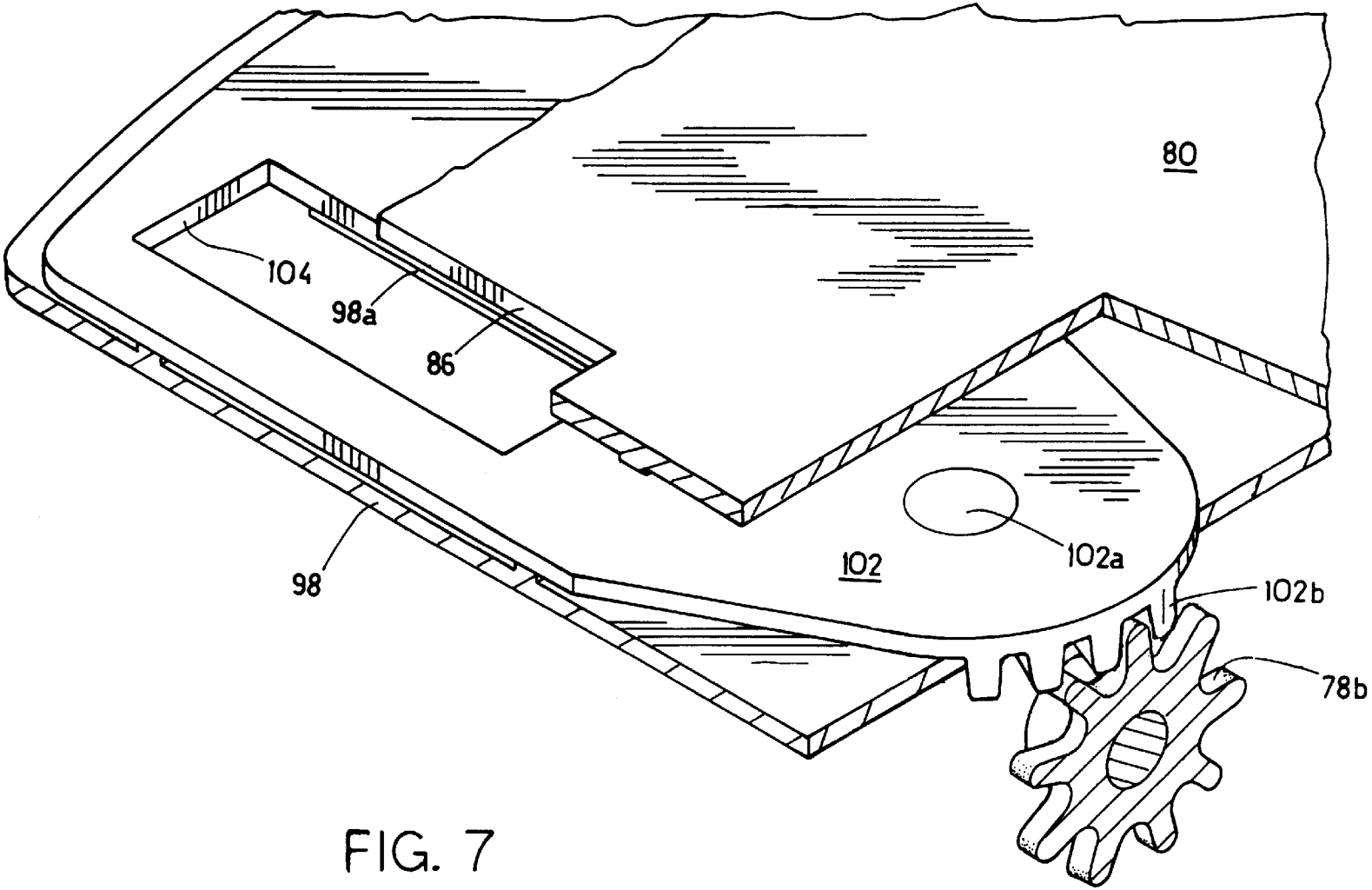
FIG. 7 is a partially cutaway perspective view showing a preferred actuating system for the blocking mechanism.

In the preferred embodiment the blocking member 102 is pivoted between the operating and blocking positions by rotation of the external lock 78. The blocking member 102 is provided with a toothed rack 102*b* which meshes with a gear 78*b* rotationally fixed to the external lock 78, as shown in FIG. 7. The blocking member 102 thus moves between the operating position shown in FIG. 4*b* and the blocking position shown in FIG. 4*c* when the external lock 78 is rotated, coinciding respectively with rotation of the latch 78*a* into and out of the locked position, respectively.

The external lock 78 thereby serves as an external actuator which actuates the release mechanism 110. This is advantageous because it is an action which service personnel must perform in order to lock the cash box 70 into the vender base 40 and in order to unlock the cash box 70 for removal from the base 40. However, it will be appreciated that other means, such as a lever which depresses or slides upon insertion of the cash box 70 into the vender base 40, may be used to actuate the blocking member 102.

Optionally a protective plate 98 is fixed to the cover 80 over the region of the blocking mechanism 100, as by bolts 99, to protect the blocking mechanism 110 against obstruction by coins 1 accumulating within the cash box 70. If provided, the protective plate 98 must include an aperture 98*a* in alignment with the coin aperture 86, so that coins 1 can drop through the protective plate 98 into the cash box 70 when the blocking mechanism 100 is in the operating position.

In operation, the hopper assembly is assembled in conventional fashion, and the base 40 is locked to the hopper assembly by engaging the center rod 38 into the threaded socket 68, mounting the body 30 and hopper assembly over the base 40 such that the center rod 38 extends up through the globe 12, placing the top 24 on the globe 12, inserting a tubular top lock 25 through the top 24 and engaging the lock 25 to the threaded upper end of the center rod 38. This effectively secures all components of the vender 10 between the base 40 and the top 24.

A cash box 70 is primed by unlocking the cover lock 82 to disengage the stem 82*a* from the socket 77 and opening the cover 80. The external lock 78 is in the unlocked position, with the latch 78*a* retracted beneath the cover 80, and the blocking member 102 is thus in the blocking position shown in FIG. 4*c*. The operator primes the cash box 70 by pivoting the tail 112*a* of the retaining dog 112 away from the detent 106 and pivoting the priming dog 114 toward the retaining dog 112 so that the head 114*b* of the priming dog 114 latches onto the head 112*b* of the retaining dog, as shown in FIG. 4. This latches the retaining dog 112 into the primed position, away from the path of the blocking member 102 (shown by the arrow in FIG. 4). The blocking member 102 will thus be able to pivot from the blocking position to the operating position when the external lock 78 is rotated to the locked position. The operator closes the cover 80, re-engages the stem 82*a* of the cover lock 82 into the socket 77, and retains the key for the cover lock 82.

The vender 10 is installed at a shopping mall, restaurant or the like, where a service person unlocks the lock 25, removes the top 24 and fills the globe 12 with merchandise. The service person inserts a primed cash box 70 into in the base 40 of the vender 10 through the opening 46, and using a key provided by the operator rotates the external lock 78 to the locked position. As the external lock 78 is rotated to the locked position (counterclockwise in the embodiment shown), locking the cash box 70 into the vender base 40, the latch 78*a* passes through the slot 88 and engages the ledge 69 underneath the bridge 60 to prevent the cash box 70 from being withdrawn from the base 40. At the same time, the gear 78*b* rotates, meshing with the rack 102*b* on the blocking member 102 to move the blocking member 102 to the operating position. As the blocking member 102 moves toward the operating position a portion of the blocking member, boss 108 in the embodiment shown, contacts the priming dog 114, as shown in FIG. 4*a*, and ultimately forces the priming dog 114 to unlatch from the head 112*b* of the retaining dog 112, as shown in FIG. 4*b*.

The blocking mechanism 100 is now in the operating position, with the aperture 104 in alignment with the coin aperture 86 and the tail 112*a* of the retaining dog 112 (now unlatched from the priming dog 114) biased against the outer edge 102*b* of the blocking member 102. The stocked vender 10 is ready for vending.

Once a sufficient number of articles have been dispensed by the vender 10, a service person attends to replace the filled cash box 70 with an empty cash box 70 primed in the manner described above. The service person rotates the external lock 78 to unlock the cash box 70 from the base 40 (clockwise in the embodiment shown). As the latch 78*a* retracts away from the ledge 69 and into the cash box 70 through the slot 88, the gear 78*b* meshes with the rack 102*a* to pivot the blocking member 102 toward the blocking position. As the blocking member 102 reaches the blocking position the spring 113 forces the tail 112*a* of the retaining dog 112 to engage into the detent 106, as shown in FIG. 4*c*. The service person draws the cash box 70 out of the base 40, and inserts the empty cash box 70, previously primed by the operator in the manner described above.

The filled cash box 70 cannot be opened by service personnel, because the operator has retained the key to the cover lock 82. With the tail 112*a* of the retaining dog 112 lodged against the blocking member 102, the blocking member 102 cannot be moved back to the operating position. Access to the coin aperture 86 thus remains blocked by the blocking member 102 until the cover 80 is opened and the retaining dog 112 is pivoted away from the detent 106 during the priming procedure, as described above. Thus, service personnel cannot gain access to the interior of the filled cash box 70. The service person returns the filled cash box 70 to the operator, who unlocks the cover lock 82, opens the cover 80 and removes the coins 1. The operator then primes the cash box 70 in the manner described above, and returns the primed cash box 70 to service personnel for use in another vender 10.

It will be noted that for effective security the retaining dog 112 must latch into the detent 106 in the blocking member 102 before the latch 78*a* completely disengages from the ledge 69 underneath the bridge 60. This will prevent service personnel from partially unlocking the external lock 78 and removing the cash box 70 before the blocking member 102 has been locked into the blocking position.

In the preferred embodiment shown the cover 80 covers the entire top of the cash box 70 and the blocking mechanism 100 is affixed to the underside of the cover 80. This is advantageous for speedy removal of coins 1 from the cash box 70 and periodic maintenance of the blocking mechanism 100. However, it will be appreciated that opening the cover 80 need not expose the entire top of the cash box 70, and it is possible to design the cash box 70 with a smaller cover 80, so that part of the top of the cash box 70 is integral with the wall 74, so long as the smaller opening allows access to the interior of the cash box 70 for emptying purposes. It is also possible to design the cash box 70 so that the cover 80 is fixed to the wall 74, and provide an opening in an end for access into the cash box 70, the blocking mechanism 100 being affixed at any convenient position in the cash box 70.

In these embodiments the blocking mechanism 100 can be designed to be primed from outside of the cash box 70, for example by adding a spring to bias the priming dog 114 against the retaining dog 112 and an opening beside the retaining dog 112 for the insertion of a tool or key configured to pivot the head 112*b* toward the blocking member 102 until the priming dog 114 latches over the head 112*b* of the retaining dog 112. This variation may not be suitable for all situations, in that the priming system could facilitate defeating the lockable feature of the cash box 70.

Preferred embodiments of the invention having been thus described by way of example only, it will be apparent to those skilled in the art that certain modifications and adaptations may be made without departing from the scope of the invention, as set out in the appended claims.

I claim:

1. A cash box comprising a container having a top, a bottom and side walls defining an interior of the container, the top including a coin aperture, and an opening allowing access to the interior of the container, a removably attachable panel releasably secured to the opening in the container by a first lock, to secure the interior of the container against access, and a blocking mechanism for blocking the coin aperture disposed within the interior of the container, comprising a blocking member having an aperture aligned with the coin aperture when the blocking member is in an operating position, the blocking member being movable between the operating position and a blocking position in which the aperture is out of alignment with the coin aperture such that the blocking member blocks the coin aperture, and a retaining mechanism for retaining the blocking member in the operating position, the blocking member having a toothed edge meshing with a gear affixed to a second lock actuable to secure the cash box within a secure compartment, wherein rotation of the second lock to a locked position moves the blocking member to the operating position and subsequent rotation of the second lock to an unlocked position for removal of the cash box from the secure compartment moves the blocking member to the blocking position and activates the retaining mechanism to retain the blocking member in the blocking position.

2. The cash box of claim 1 in which the retaining mechanism comprises a retaining dog movable between a position in a path of travel of the blocking member and a position out of a path of travel of the blocking member.

3. The cash box of claim 2 in which the retaining dog is biased against the blocking member.

4. The cash box of claim 3 in which the retaining dog is retained in a primed position out of the path of travel of the blocking member by a priming dog movable between a position in which the priming dog is spaced from the retaining dog and a position in which the priming dog contacts the retaining dog to secure the retaining dog in the primed position.

5. The cash box of claim 4 in which the priming dog is moved from the position in which the priming dog contacts the retaining dog to the position spaced from the retaining dog by the blocking member as the blocking member moves to the operating position.

6. A cash box comprising a container having a bottom and side walls defining an interior of the container, a top comprising a removably attachable cover releasably secured to the container by a cover lock, to secure the interior of the container against access, the top including a coin aperture, and a blocking mechanism for blocking the coin aperture disposed within the container, comprising a blocking member having an aperture aligned with the coin aperture when the blocking member is in an operating position, the blocking member being movable between the operating position and a blocking position in which the aperture is out of alignment with the coin aperture such that the blocking member blocks the coin aperture, and a retaining mechanism for retaining the blocking member in the operating position, the blocking member having a toothed edge meshing with a gear affixed to a second lock actuable to secure the cash box within a secure compartment, wherein the retaining mechanism is primed from the interior of the container to allow the blocking member to move from the blocking position to the operating position, and whereby rotation of the second lock in a locking direction moves the blocking member to the operating position and releases the retaining mechanism such that subsequent rotation of the second lock in an unlocking direction moves the blocking member to the blocking position and allows the retaining mechanism to retain the blocking member in the blocking position.

7. The cash box of claim 6 in which the retaining mechanism comprises a retaining dog movable between a position in a path of travel of the blocking member and a position out of a path of travel of the blocking member.

8. The cash box of claim 7 in which the retaining dog is biased against the blocking member.

9. The cash box of claim 8 in which the retaining dog is retained in a primed position out of the path of travel of the blocking member by a priming dog movable between a position in which the priming dog is spaced from the retaining dog and a position in which the priming dog contacts the retaining dog to secure the retaining dog in the primed position.

10. The cash box of claim 9 in which the priming dog is moved from the position in which the priming dog contacts the retaining dog to the position spaced from the retaining dog by the blocking member as the blocking member moves to the operating position.

11. A vender comprising a merchandise storage portion and a secure compartment defined within a body of the vender, a coin mechanism mounted in the body for receiving a coin or token and conveying the coin or token into the secure compartment for deposit into a cash box, the cash box comprising a container having a top, a bottom and side walls defining an interior of the container, the top including a coin aperture, and an opening allowing access to the interior of the container, a removably attachable panel releasably secured to the opening in the container by a first lock, to secure the interior of the container against access, and a blocking mechanism for blocking the coin aperture disposed within the container, comprising a blocking member having an aperture aligned with the coin aperture when the blocking member is in an operating position, the blocking member being movable between the operating position and a blocking position in which the aperture is out of alignment with the coin aperture such that the blocking member blocks the coin aperture, and a retaining mechanism for retaining the blocking member in the operating position, the blocking member having a toothed edge meshing with a gear affixed to a second lock actuable to secure the cash box within the secure compartment, wherein rotation of the second lock to a locked position moves the blocking member to the operating position and subsequent rotation of the second lock to an unlocked position for removal of the cash box from the secure compartment moves the blocking member to the blocking position and activates the retaining mechanism to retain the blocking member in the blocking position.

12. The vender of claim 11 in which the retaining mechanism comprises a retaining dog movable between a position in a path of travel of the blocking member and a position out of a path of travel of the blocking member.

13. The vender of claim 12 in which the retaining dog is biased against the blocking member.

14. The vender of claim 13 in which the retaining dog is retained in a primed position out of the path of travel of the blocking member by a priming dog movable between a position in which the priming dog is spaced from the retaining dog and a position in which the priming dog contacts the retaining dog to secure the retaining dog in the primed position.

15. The vender of claim 14 in which the priming dog is moved from the position in which the priming dog contacts the retaining dog to the position spaced from the retaining dog by the blocking member as the blocking member moves to the operating position.

16. The vender of claim 11 in which a chute disposed between the coin mechanism and the coin aperture.

17. The vender of claim 11 in which the body comprises a base and a rod secures the merchandise storage portion to the base, the rod being secured to a bridge extending across an upper portion of the base and secured to a wall of the base, providing a clear space within the base for slidably receiving the cash box.

* * * * *